US009205549B1

(12) United States Patent
Lin

(10) Patent No.: US 9,205,549 B1
(45) Date of Patent: Dec. 8, 2015

(54) RETRACTABLE BAR FOR HAND TOOL

(71) Applicant: Thomas Lin, Taichung (TW)
(72) Inventor: Thomas Lin, Taichung (TW)

( * ) Notice: Subject to any disclaimer, the term of this patent is extended or adjusted under 35 U.S.C. 154(b) by 0 days.

(21) Appl. No.: 14/331,568

(22) Filed: Jul. 15, 2014

(51) Int. Cl.
*B25G 1/04* (2006.01)

(52) U.S. Cl.
CPC ..... *B25G 1/04* (2013.01); *Y10T 16/473* (2015.01); *Y10T 16/4719* (2015.01)

(58) Field of Classification Search
CPC .... B25G 1/04; Y10T 16/451; Y10T 16/4719; Y10T 16/473
See application file for complete search history.

(56) References Cited

U.S. PATENT DOCUMENTS 3,347,575 A * 10/1967 Morris ..... F16B 7/105 16/429
3,425,756 A * 2/1969 Hubbard ..... A47J 45/10 16/427
5,220,707 A * 6/1993 Newman, Sr. ..... B05C 17/0205 15/144.4
5,228,202 A * 7/1993 Liao ..... B25G 1/04 15/144.4
5,288,161 A * 2/1994 Graves ..... B05C 17/0205 15/145
5,404,616 A * 4/1995 Carmien ..... B25G 1/04 16/422
5,694,663 A * 12/1997 Tserng ..... A45C 13/262 16/113.1
5,729,865 A * 3/1998 Stoddart ..... B05C 17/0205 16/429
6,061,871 A * 5/2000 Wang ..... A45C 13/262 16/113.1
6,220,240 B1 * 4/2001 Grady ..... B62B 5/06 126/276
6,883,208 B1 * 4/2005 Huang ..... B25G 1/04 16/110.1
7,694,387 B1 * 4/2010 Huang ..... B25G 1/04 16/113.1
7,774,901 B1 * 8/2010 Huang ..... B25G 1/04 16/113.1
8,677,595 B2 * 3/2014 Zeng ..... A47L 9/248 15/414
8,683,657 B2 * 4/2014 Lin ..... B25G 1/04 16/426
8,684,620 B2 * 4/2014 Lin ..... B25G 1/04 16/429
D712,230 S * 9/2014 Atnip ..... D8/107
8,875,350 B2 * 11/2014 Bukovitz ..... B25G 3/00 16/427
2007/0295571 A1 * 12/2007 Tong ..... A47L 9/244 191/12 R
2010/0186181 A1 * 7/2010 Tawara ..... A47L 13/38 15/144.4
2011/0271483 A1 * 11/2011 Lai ..... A45C 13/26 16/113.1
2012/0174417 A1 * 7/2012 Huang ..... A01G 3/0251 30/312
2013/0185945 A1 * 7/2013 Wang ..... B25G 1/04 30/341
2014/0059808 A1 * 3/2014 Lin ..... B25G 1/04 16/429
2014/0064842 A1 * 3/2014 Lin ..... B25G 1/04 403/379.5
2014/0130306 A1 * 5/2014 Andel ..... G01V 3/15 16/429

FOREIGN PATENT DOCUMENTS

TW 556480 U 10/2003

* cited by examiner

*Primary Examiner* — Jeffrey O Brien
(74) *Attorney, Agent, or Firm* — Muncy, Geissler, Olds & Lowe, P.C.

(57) ABSTRACT

A retractable bar is provided to include an inner tube and an outer tube sleeved onto the inner tube. A positioning assembly has a sliding block movably disposed in the outer tube, a locating pin axially inserted in a guiding slot of the sliding block and abutted against an abutment portion of the sliding block, and a knob connected to the sliding block through a linking member for driving the sliding block to move. By this way, when the sliding block is driven by the linking member to move along an axial direction of the outer tube, the locating pin will be pushed by the abutment portion of the sliding block to disengaged from a locating hole of the inner tube, such that the inner and outer tubes can be moved relative to each other, thereby achieving adjustment of the length of the retractable bar.

6 Claims, 6 Drawing Sheets

RETRACTABLE BAR FOR HAND TOOL

BACKGROUND OF THE INVENTION

1. Technical Field

The present invention relates to a retractable bar for use in a hand tool, and more particularly, to a retractable bar that is simple in structure and easy to be operated.

2. Description of Related Art

To fit different application distances, conventional hand tools, such as garden shears, commonly provide a retractable design to facilitate operation. For example, Taiwan Patent No. 556480 disclosed a retractable garden tool, entitled "Improved Structure of Retractable Handle for Garden Shears". When the user presses a button, a positioning block of a sliding block will be disengaged from a locating notch of an inner tube, allowing movement of the sliding block to adjust the extending length of the inner tube. After the inner tube is adjusted to a desired extending length, the user can release the button, enabling the button to be returned to its former position by a spring member to force the positioning block of the sliding block into engagement with another locating notch of the inner tube. Thus, the inner tube is locked to the outer tube in the adjusted position.

However, in the aforesaid prior art design, the button and the sliding block are joined together by means of engagement between a retaining flange of a mounting shaft of the button and a retaining hole of a column of the sliding block, and insertion of a pin through the mounting shaft into the bottom side of the retaining hole of the sliding block. Accordingly, the aforesaid prior art design is constructed by a large number of component parts, complicating the installation procedure and increasing the manufacturing cost.

SUMMARY OF THE INVENTION

It is an objective of the present invention to provide a retractable bar for use in a hand tool, which has a simple structure, facilitating operation, and low manufacturing cost.

In order to achieve the above objective, the retractable bar of the present invention comprises an inner tube having a plurality of locating holes arranged in a spaced manner and an outer tube axially movably sleeved onto the inner tube and having a first hollow portion at one end thereof and a second hollow portion at the other end thereof. A positioning assembly includes a base sleeved onto the outer tube and having a mounting chamber in communication with the first hollow portion of the outer tube, a sliding block slidably disposed in the first hollow portion of the outer tube and the mounting chamber of the base and having an abutment portion with a guiding slot, and a knob movably disposed on the second hollow portion of the outer tube. Further, the positioning assembly has a linking member disposed in the outer tube and connected between the sliding block and the knob through the first and second hollow portions of the outer tube, a locating pin axially movably mounted in the mounting chamber of the base and inserted into one of the locating holes of the inner tube through the guiding slot of the sliding block and provided with an outer flange abutted against the abutment portion of the sliding block, and a first restoring spring sleeved onto the locating pin and stopped between an inner surface of the base and the outer flange of the locating pin.

By means of the aforesaid design, when the sliding block is pulled by the knob to move along an axial direction of the outer tube, the abutment portion of the sliding block pushes the outer flange of the locating pin to enable the bottom end of the locating pin to remove from the locating hole of the inner tube, allowing the outer tube to be moved axially relative to the inner tube to adjust the length of the retractable bar.

Preferably, a second restoring spring is used to stop against a stop wall of the base and an outer end surface of the sliding block for providing a restoring force to the sliding block.

Preferably, an elastic sheet is used to stop against the outer flange of the locating pin. One end of the elastic sheet is mounted to the base and the other end of the elastic sheet has a through hole for insertion of a bottom end of the locating pin. Thus, when moved, the sliding block pushes upwards the outer flange of the locating pin through the elastic sheet for enhancing operational reliability of the locating pin.

DETAILED DESCRIPTION OF THE INVENTION

Figure 1:
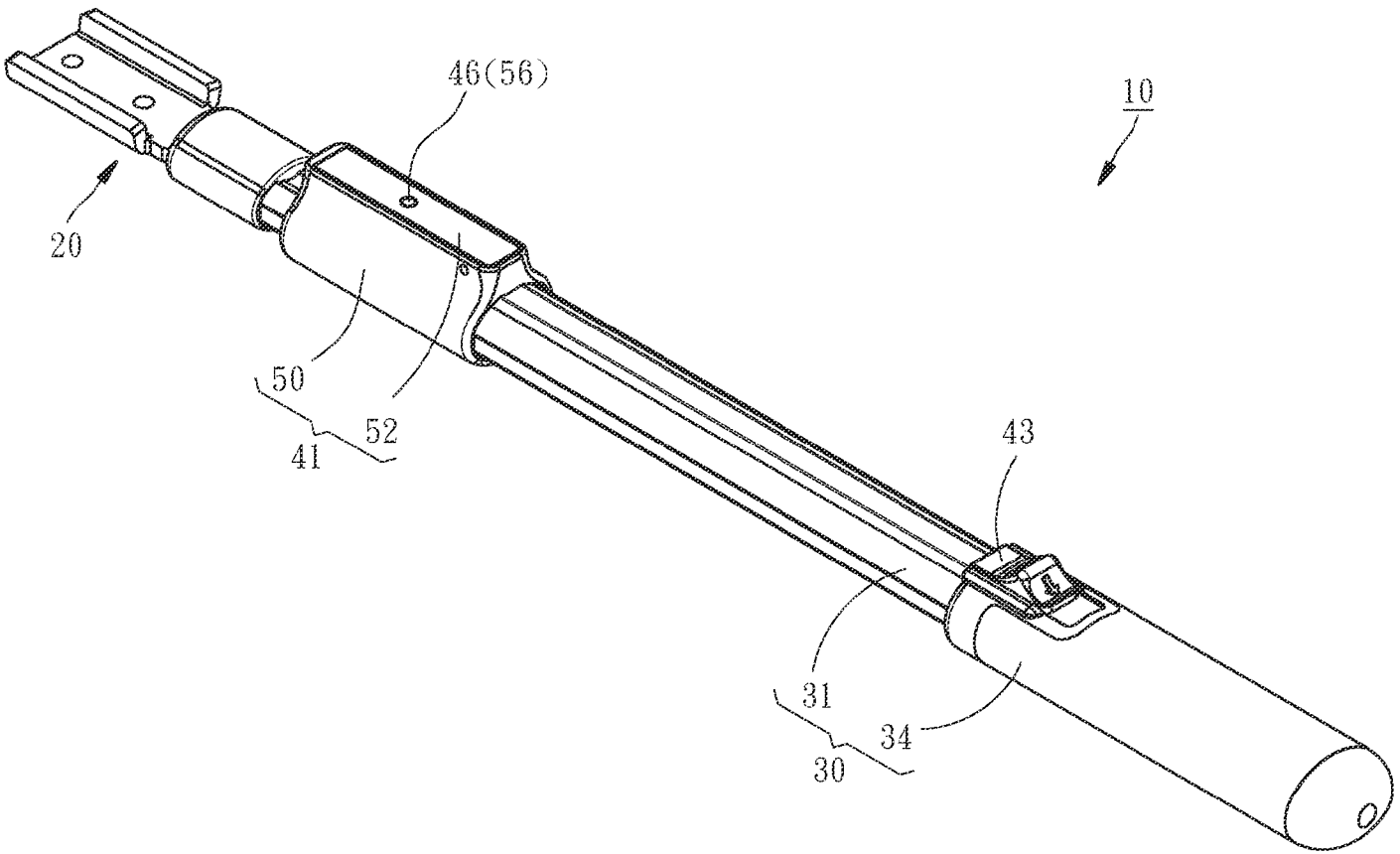
FIG. 1 is a perspective view of a retractable bar in accordance with the present invention.
Figure 2:
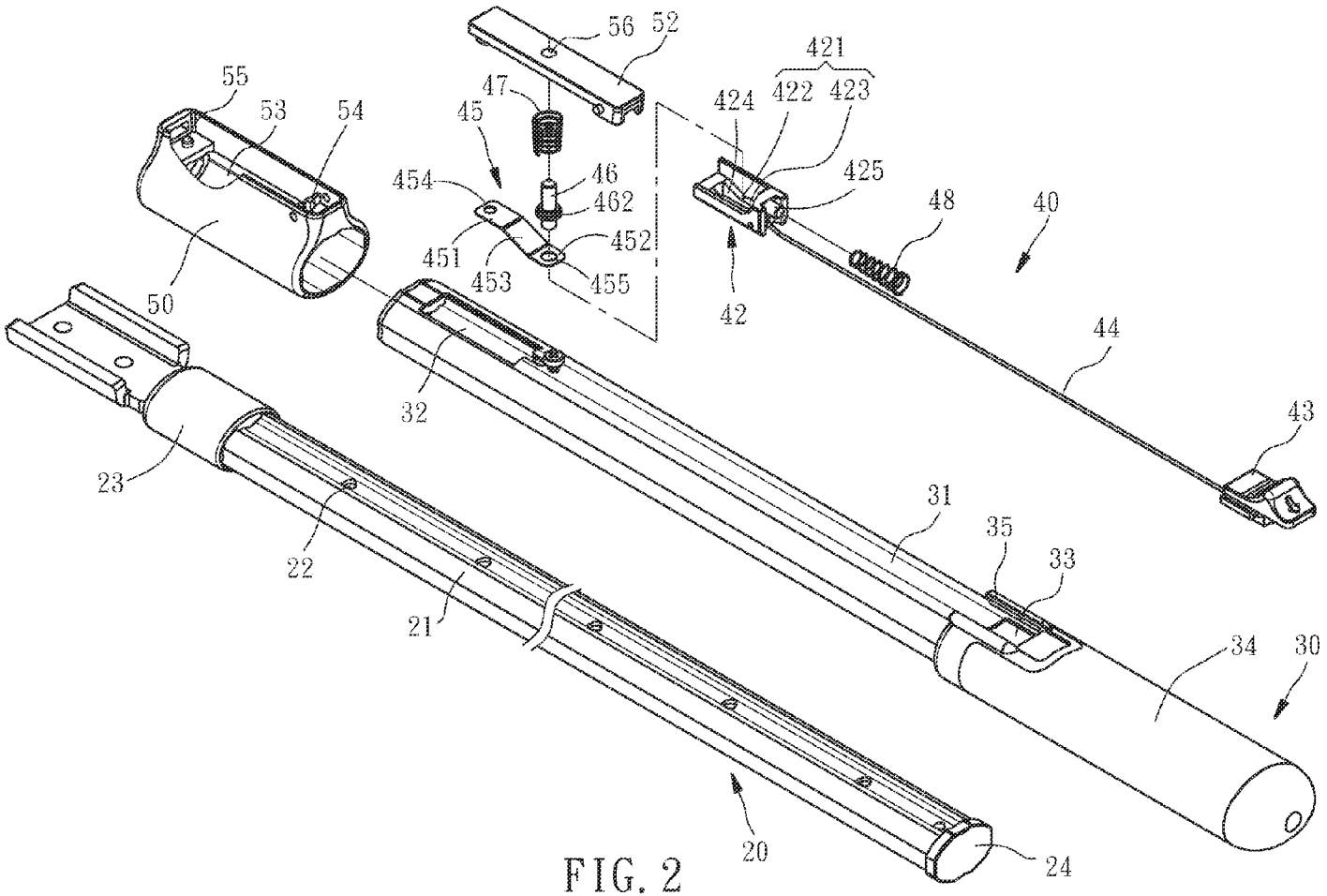
FIG. 2 is an exploded view of a part of the retractable bar in accordance with the present invention.
Figure 3:
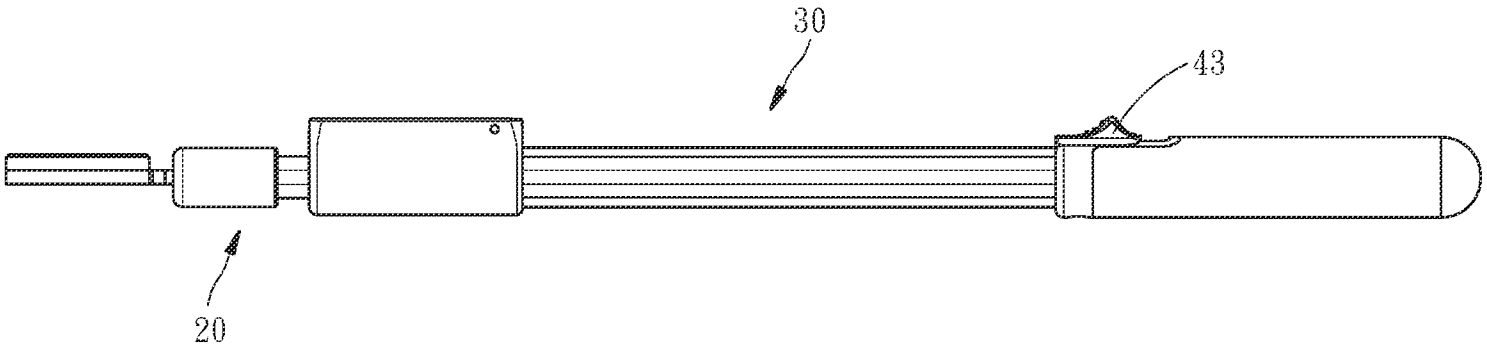
FIG. 3 is a lateral view of the retractable bar in accordance with the present invention.

Referring to FIGS. 1 and 2, a retractable bar 10 in accordance with the present invention is used in a garden shear or the like, comprising an inner tube 20, an outer tube 30, and a positioning assembly 40.

The inner tube 20 has an inner tube body 21 with a plurality of spaced locating holes 22, and two end caps 23 and 24 fastened to two ends of the inner tube body 21, respectively.

The outer tube 30 has an outer tube body 31 axially and slidably sleeved onto the inner tube 20 and provided with a first hollow portion 32 at front end thereof and a second hollow portion 33 at rear end thereof. Further, the outer tube 30 has a grip 34 sleeved onto the rear end of the outer tube body 31 and provided with an insertion groove 35 corresponding to the second hollow portion 33 of the outer tube body 31.

Figure 4:
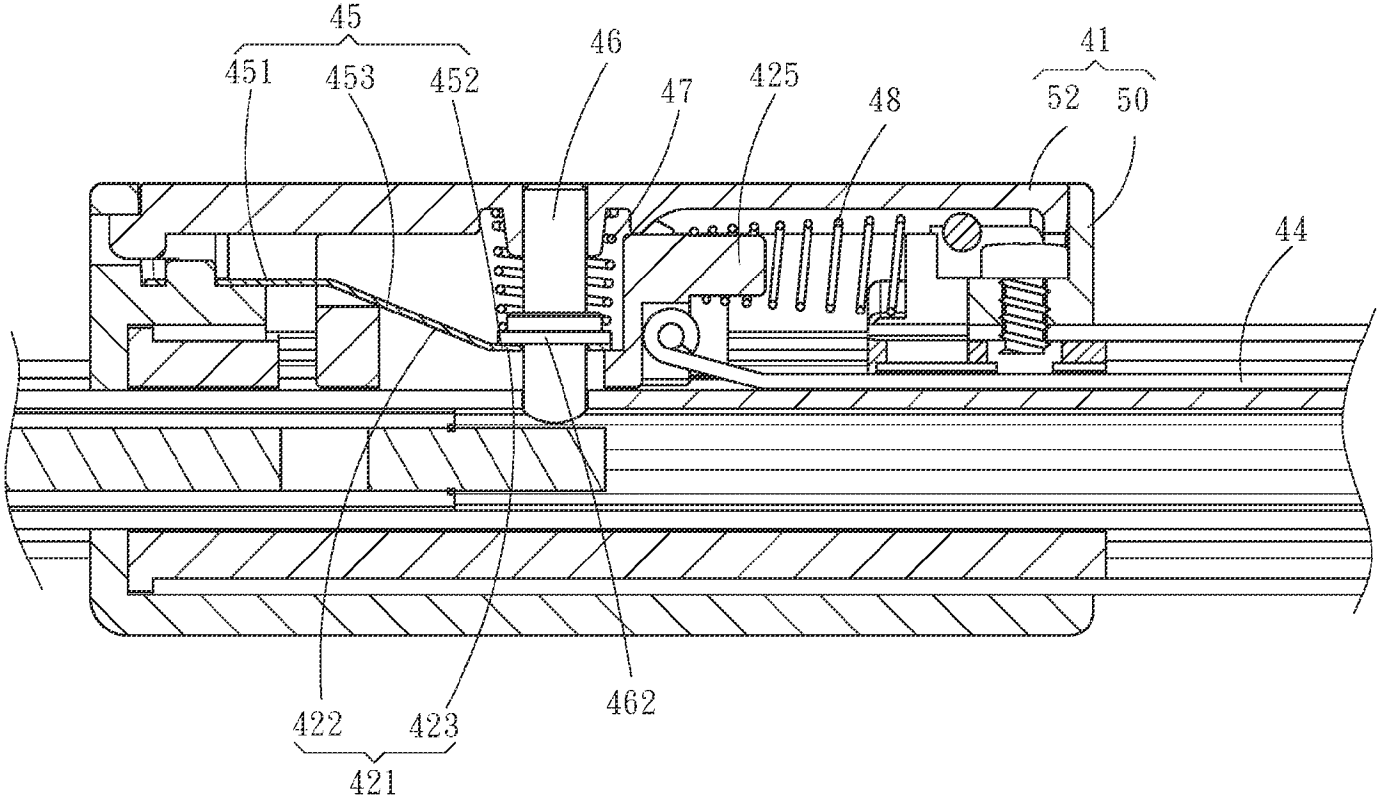
FIG. 4 is a sectional view of a part of the retractable bar in accordance with the present invention, showing that the locating pin is inserted into the locating hole of the inner tube.

As shown in FIGS. 2 and 4, the positioning assembly 40 includes a base 41, a sliding block 42, a knob 43, a linking member 44, an elastic sheet 45, a locating pin 46, a first restoring spring 47, and a second restoring spring 48.

The base 41 has a base body 50 sleeved onto the front end of the outer tube body 31 of the outer tube 30 and provided with a mounting chamber 53 in communication with the first hollow portion 32 of the outer tube 30, a stop wall 54 located at the rear end of the mounting chamber 53, and a retaining protrusion 55 located at the front end of the mounting chamber 53. A cover plate 52 is fastened to the top side of the base body 50 to cover the mounting chamber 53. The cover plate 52 is provided with a limiting hole 56 in communication with the mounting chamber 53.

The sliding block 42 is movably inserted between the first hollow portion 32 of the outer tube 30 and the mounting chamber 53 of the base 41. As shown in FIGS. 2 and 4, the sliding block 42 has an abutment portion 421 with an inclined surface 422, a horizontal bottom surface 423 connected with the inclined surface 422, and a guiding slot 424 extending from the inclined surface 422 to the horizontal bottom surface 423. Further, a post 425 is protruded from an outer end surface of the sliding block 42 toward the stop wall 54 of the base 41.

The knob 43 is movably inserted in the insertion groove 35 of the grip 34 of the outer tube 30 so as to be moveable corresponding to the second hollow portion 33 of the outer tube 30, as shown in FIGS. 1 and 2.

The linking member 44 is embodied as a steel wire and disposed in the outer tube 30 and connected between the sliding block 42 and the knob 43 through the first and second hollow portions 32 and 33 of the outer tube 30, such that the sliding block 42 can be driven by the knob 43 to move through the linking member 44.

Figure 5:
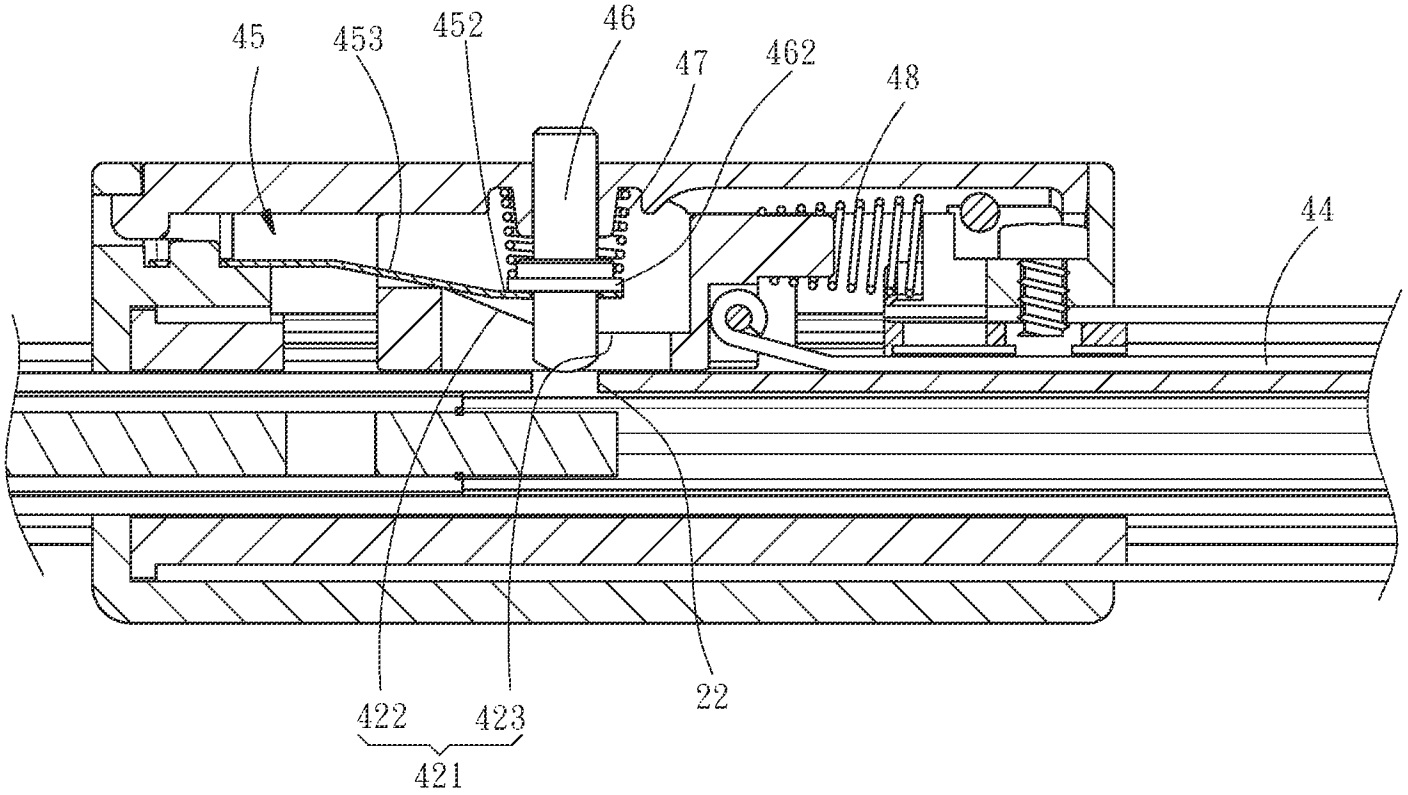
FIG. 5 is similar to FIG. 4, but showing that the outer flange of the locating pin is pushed by the abutment portion of the sliding block.

As shown in FIGS. 2, 4, and 5, the elastic sheet 45 includes a first horizontal section 451 having a retaining hole 454 sleeved onto the retaining protrusion 55 of the base 41, a second horizontal section 452 abutted against the horizontal bottom surface 423 of the abutment portion 421 of the sliding block 42 and having a through hole 455 in communication with the guiding slot 424 of the sliding block 42, and an inclined section 453 connected between the first and second horizontal sections 451 and 452 and abutted the inclined surface 422 of the abutment portion 421 of the sliding block 42.

The locating pin 46 has a top end axially inserted into the limiting hole 56 of the cover plate 52 of the base 41 and a bottom end axially inserted into one of the locating holes 22 of the inner tube 20 through the through hole 455 of the elastic sheet 45 and the guiding slot 424 of the sliding slot 42, such that an interference between the sliding block 42 and the locating pin 46 may not occur when the sliding block 42 is moved. Further, the locating pin 46 has an outer flange 462 abutted against the second horizontal section 452 of the elastic sheet 45, as shown in FIG. 4.

The first restoring spring 47 is a compression spring. When assembled, the first restoring spring 47 is sleeved onto the top portion of the locating pin 46 and stopped between the inner surface of the cover plate 52 of the base 41 and the outer flange 462 of the locating pin 46 for providing a restoring force to the locating pin 46.

The second restoring spring 48 is a compression spring. When assembled, the second restoring spring 48 is sleeved onto the post 425 of the sliding block 42 and stopped between the stop wall 54 of the base 41 and the outer end surface of the sliding block 42 for providing a restoring force to the sliding block 42.

Figure 6:
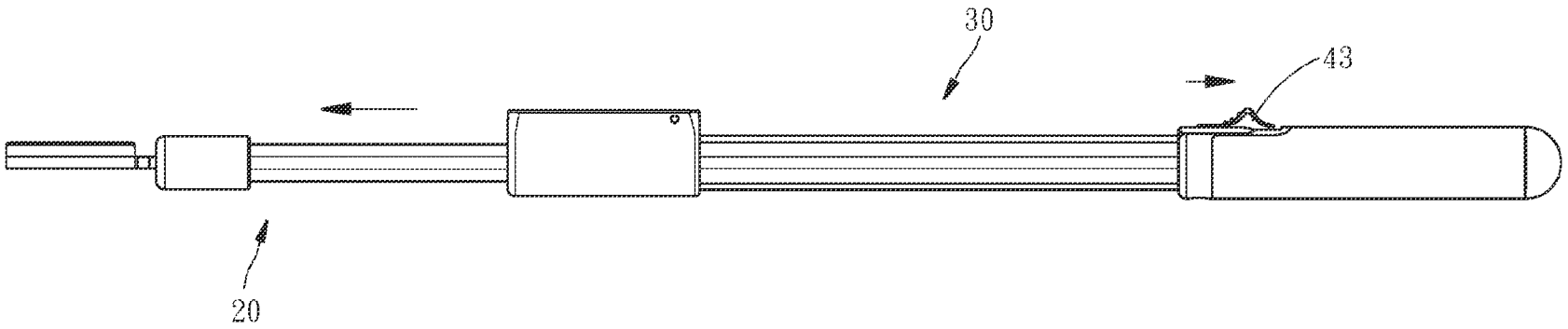
FIG. 6 is similar to FIG. 3, but showing that the retractable bar is adjusted.

For adjustment of the length of the retractable bar 10, a pressure is imparted to the knob 43 to move the sliding block 42 through the linking member 44. During the movement of the sliding block 42, as shown in FIG. 5, the second restoring spring 48 is compressed and meanwhile the inclined section 453 of the elastic sheet 45 is pushed by the inclined surface 422 of the abutment portion 421 of the sliding block 42. At this time, the elastic sheet 45 is deformed to push upwards the outer flange 462 of the locating pin 46 through its second horizontal section 452, such that the locating pin 46 is forced away from one of the locating holes 22 of the inner tube 20 and meanwhile the first restoring spring 47 is compressed. Thereafter, as shown in FIG. 6, the inner tube 20 can be pushed or pulled relative to the outer tube 30 to adjust the retractable bar 10 subject to the desired length. After the inner tube 20 has been moved to the desired position, the pressure imparted on the knob 43 can be released, enabling the sliding block 42 to be returned to its former position shown in FIG. 4 by the spring force of the second restoring spring 48. Once the sliding block 42 is moved back, the force applied to the outer flange 462 of the locating pin 46 is released such that the locating pin 46 is pushed by the first restoring spring 47 to insert into another one of the locating holes 22 of the inner tube 20, locking the inner tube 20 to the outer tube 30 in the adjusted position.

As indicated above, the retractable bar 10 of the present invention achieves adjustment by means of the cooperation between the abutment portion 421 of the sliding block 42 and the outer flange 462 of the locating pin 46 and the assistance of the elastic sheet 45. When compared to the prior art, the present invention has more simple structure and facilitates operation, enhancing convenience in use and reducing manufacturing cost.

What is claimed is:

1. A retractable bar comprising:

an inner tube having a plurality of spaced locating holes;

an outer tube axially movably sleeved onto the inner tube, the outer tube having a first hollow portion at a first end thereof and a second hollow portion at a second end thereof;

and a positioning assembly including a base sleeved onto the outer tube and having a mounting chamber in communication with the first hollow portion of the outer tube, a sliding block slidably disposed in the first hollow portion of the outer tube and the mounting chamber of the base and having an abutment portion with a guiding slot, a knob movably disposed on the second hollow portion of the outer tube, a linking member disposed in the outer tube and connected between the sliding block and the knob through the first and second hollow portions of the outer tube, a locating pin axially movably mounted in the mounting chamber of the base and inserted into one of the locating holes of the inner tube through the guiding slot of the sliding block and having an outer flange abutted against the abutment portion of the sliding block, and a first restoring spring sleeved onto the locating pin and stopped between an inner surface of the base and the outer flange of the locating pin;

wherein the abutment portion of the sliding block has an inclined surface, a horizontal bottom surface connected with the inclined surface and abutted against the outer flange of the locating pin, and the guiding slot extending from the inclined surface to the horizontal bottom surface;

wherein the positioning assembly further comprises an elastic sheet having a first horizontal section mounted to the base, a second horizontal section abutted against the horizontal bottom surface of the abutment portion of the sliding block and having a through hole for insertion of a bottom end of the locating pin, and an inclined section connected between the first and second horizontal sections and abutted against the inclined surface of the abutment portion of the sliding block.

2. The retractable bar of claim 1, wherein the first horizontal section of the elastic sheet has a retaining hole sleeved onto a retaining protrusion of the base.

3. The retractable bar of claim 1, wherein the outer tube includes a tube body having the first and second hollow portions, and a grip sleeved onto one end of the tube body and having an insertion groove for insertion of the knob.

4. The retractable bar of claim 1, wherein a top end of the locating pin is axially inserted into a limiting hole of a cover plate of the base, and the first restoring spring is stopped between an inner surface of the cover plate of the base and the outer flange of the locating pin.

5. The retractable bar of claim 1, wherein the positioning assembly further comprises a second restoring spring sleeved onto a post of the sliding block and stopped between a stop wall of the base and an outer end surface of the sliding block.

6. The retractable bar of claim 1, wherein the linking member is a steel wire.

* * * * *